US006499946B1

(12) United States Patent
Yamada et al.

(10) Patent No.: US 6,499,946 B1
(45) Date of Patent: Dec. 31, 2002

(54) STEAM TURBINE ROTOR AND MANUFACTURING METHOD THEREOF

(75) Inventors: Masayuki Yamada; Takao Inukai, both of Yokohama; Masataka Kikuchi, Chigasaki; Joji Kaneko, Tokyo; Satoru Asai, Yokohama; Yoichi Tsuda; Ryuichi Ishii, both of Tokyo; Yomei Yoshioka, Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/692,179

(22) Filed: Oct. 20, 2000

(30) Foreign Application Priority Data

Oct. 21, 1999 (JP) ..... 11-299452
Nov. 2, 1999 (JP) ..... 11-312782
Feb. 24, 2000 (JP) ..... 2000-047252

(51) Int. Cl.[7] ..... F03B 1/04
(52) U.S. Cl. ..... 415/199.4; 415/200

(58) Field of Search ..... 415/200, 216.1, 415/199.4–199.5, 221, 220; 416/201 R, 198 A, 213 R, 244 R, 244 A, 241 R

(56) References Cited

U.S. PATENT DOCUMENTS 5,407,497 A 4/1995 Hassan et al.
6,152,697 A * 11/2000 Konishi et al. ..... 416/213 R

FOREIGN PATENT DOCUMENTS

JP 50-158544 12/1975
JP 2000-064805 2/2000

* cited by examiner

*Primary Examiner*—Edward K. Look
*Assistant Examiner*—Dwayne White
(74) *Attorney, Agent, or Firm*—Oblon, Spivak, McClelland, Maier & Neustadt, P.C.

(57) ABSTRACT

A steam turbine rotor having a combination of at least one of a high pressure rotor, an intermediate pressure rotor and a low pressure rotor, which are each formed from a metal material of different chemical composition and welded together by means of welding.

20 Claims, 11 Drawing Sheets

STEAM TURBINE ROTOR AND MANUFACTURING METHOD THEREOF

BACKGROUND OF THE INVENTION

The present invention relates to a steam turbine rotor having a connection structure for application to a steam turbine plant that includes in combination at least two of a high pressure steam turbine, an intermediate steam turbine and a low pressure steam turbine, and also relates to a method of manufacturing the steam turbine rotor.

In a typical steam turbine plant equipped with a high pressure steam turbine, an intermediate pressure steam turbine and a low pressure steam turbine, a material (metal material) of a steam turbine rotor incorporated into each turbine is selected depending on the steam conditions used, e.g., pressure, temperature, flow rate, etc. The steam turbine rotor for use in the high pressure steam turbine and intermediate steam turbine having the steam temperature of 550° C. to 600° C. can be made of e.g., 1%CrMoV steel (ASTM-A470, class 8) or 12%Cr steel (Japanese Patent Pub. No. SHO 60-54385). The steam turbine rotor for use in the low pressure steam turbine having the steam temperature equal to or higher than 400° C. can be made of, e.g., NiCrMo steel (ASTM-A471, classes 2 to 7) containing 2.5% or more Ni.

In a recent steam turbine plant directed toward a larger capacity and a higher efficiency, due to the necessity for each turbine of a reduced size and weight and of a simple structure, a lot of attention is being paid to the appearance of so-called high-low pressure integrated, high-intermediate-low pressure integrated, or intermediate-low pressure integrated steam turbine rotors integrated into one piece and using the same metal material for each steam turbine including the high pressure steam turbine to the low pressure steam turbine.

Such a one-piece steam turbine rotor needs a sufficient high-temperature creep rupture strength on its high pressure high temperature side and needs a sufficient tensile strength, yield strength and toughness on its low pressure/low temperature side. This means that a single rotary shaft (rotor) requires different mechanical characteristics. Specifically, the metals used in the commercial machines are 1%CrMoVNiNb steel (e.g., Japanese Patent Pub. No. SHO 58-13608), 1.7%Ni2.25%CrMoVWNb steel (e.g., Japanese Patent Laid-open Pub. No. HEI 7-316721), etc.

Although the above described one-piece steam turbine rotors is integrally molded from the initial step of fabrication, previously separately fabricated high, intermediate and low pressure steam turbine rotors may be joined together by bolts (e.g., Japanese Patent Laid-open Pub. No. SHO 62-189301) or may be welded together.

The steam turbine rotor having the welded structure is classified into two types depending on the step to weld each steam turbine rotor. One is obtained by the welding in the process of the steam turbine rotor manufacturing steps and the other is obtained by the mutual welding after the completion of manufacture of each steam turbine rotor.

For the manufacture of the former, a plurality of ingots are roughly forged, welded together and then finish forged, which is disclosed in e.g., Japanese Patent Laid-open Pub. No. SHO 53-147653.

For the manufacture of the latter, the steam turbine rotors formed from dissimilar metal of different components and compositions are welded together, which is disclosed in e.g., Japanese Patent Laid-open Pub. No. SHO 57-176305.

It has hitherto been common for the high pressure, intermediate pressure and low pressure steam turbine rotors to provide a disk-structure (in which the steam turbine rotors each has an sliced disk shape so that they are laid one on top of the other) for the welded connection thereof. In this case, the steam turbine rotors formed from the same metal of the same components and compositions are welded and connected without welding the ones made of the dissimilar metal of different components and compositions.

Use of ESR (electroslag remelting) process is proposed as the other connection method to be effected during the steam turbine rotor manufacturing steps.

This connection method can include some approaches, i.e., immediately after the electroslag melting of one consumable electrode, the other consumable electrode may be subjected to the electroslag melting, with the resultant two parts being joined together for integral molding (e.g., Japanese Patent Pub. No. SHO 53-42446), a plurality of ingots of different components and compositions may be connected together for being remelted as the ESR electrode (e.g., Japanese Patent Pub. No. SHO 56-14842), or with a view to reducing the pool depth at the center, hollow electrodes may be connected together for ESR (e.g., Japanese Patent Laid-open Pub. No. HEI 6-155001).

In this manner, a number of connection means have been disclosed for the conventional steam turbine rotors, and some of them have been adopted for the commercial machines.

The recent steam turbine plant has a trend toward enhancement on the reduced size and weight as well as the simplified structure, and from this viewpoint, investigation is directed to the high-low pressure, high-intermediate-low pressure or intermediate-low pressure steam turbine rotors.

The conventional steam turbine rotors are formed from metals of components and compositions which have been developed in conformity with the steam conditions such as the steam temperature and pressure of the individual steam turbines, i.e., high pressure, high-intermediate pressure, intermediate pressure and low pressure steam turbines. Thus, intact application of those metals of the components and compositions to the high-low pressure, high-intermediate-low pressure and intermediate-low pressure steam turbines would pose deficiencies which follow.

(1) The 1%CrMoV rotor has a good performance in the creep rupture strength within the high-temperature region of the order of 550° C., although it may not necessarily present a sufficient tensile strength and toughness within the low temperature region and may possibly undergo a ductile fracture, a brittle fracture, etc. As the prevention measures against those, it is necessary to reduce the stress which may occur at the low-pressure part of the steam turbine rotor. However, the reduction of the stress occurring at the low-pressure part may restrict the length of the turbine blades disposed at the turbine stages, to consequently make it difficult to enhance the power plant capability.

In spite of its excellent high-temperature creep rupture strength, it would be insufficient for the higher temperature (approx. 600° C. ) and higher pressure steam at the turbine inlet, which is required to achieve an improved efficiency in the recent power plant.

(2) The 12%Cr rotor could satisfy the above turbine inlet steam conditions due to its superior characteristics in the high temperature creep rupture strength to the 1%CrMoV steel rotor, but it presents an insufficient toughness. As a countermeasure against this fact, the length of the turbine blades disposed at the low pressure turbine stages is restricted, in the same manner as the case of the 1%CrMoV rotor.

(3) The NiCrMoV steel rotor is advantageous in the tensile strength and toughness within the low temperature region, but it may fail to present a sufficient creep rupture strength therewithin. Thus, its use in the high pressure steam turbine or intermediate pressure steam turbine may restrict the rise of the steam temperature at the turbine inlet due to its insufficient strength, making it difficult for the power plant to achieve an improved efficiency.

In this manner, when attempting to impart the increased capacity and higher efficiency to the steam turbine plant, especially, by use of the high temperature and high pressure steam with the turbine blade of a larger length incorporated therein, many restrictions have been imposed on the conventional high-low, high-intermediate-low and intermediate-low pressure integrated steam turbine rotors formed from the same material (metal material) such as the heat resisting steel.

Nevertheless, small-sized steam turbines with a small power output have used high-low, high-intermediate-low and intermediate-low pressure integrated steam turbine rotors formed from the same metal of the same components and compositions. In order to improve the steam turbine performances and enlarge the output range, however, it is necessary to increase the length of the turbine blade at the last turbine stage. In fact, increase of the turbine blade length may result in the increased centrifugal force due to rotations, and an extremely large stress may occur in the steam turbine rotor. To deal with this increased stress, the steam turbine rotor needs to have a further improved tensile strength, yield strength and toughness at the last turbine stage and its peripheries.

Moreover, the turbine blade at the last turbine stage may be made of titanium in place of the conventional steel with a view to reducing the costs and centrifugal force. Due to its elongated shape, however, the titanium turbine blade will not contribute to the reduction of the centrifugal force than expected. For this reason, the steam turbine rotor is still subjected to a large stress.

Thus, there is a need to acquire an even superior tensile strength, yield strength and toughness as well as to keep the creep rupture strength at a high temperature. In the state of the art, however, the integral steam turbine rotor have not yet been realized that is made of the same components and compositions and is capable of satisfying the need for steam turbines for the high-low pressure, high-intermediate-low pressure and intermediate-low pressure.

As a substitute for the high-low, the high-intermediate-low pressure integrated steam turbine rotor made of the same components and compositions, combination of the steam turbine rotors made of dissimilar metal would be conceivable. A bolting method is an example thereof. However, the bolting method is disadvantageous in the simplification of the structure and the reduction of weight of the steam turbine, since it needs the provision of flanged portions for fastening by means of bolts or bolt/nut pairs and needs the provision of a larger gap than the design proper value between wheels clamping the fastened portion of the steam turbine. Furthermore, the repetition of the start and stop operations of the steam turbine may cause a reduction of bolt fastening force, i.e., a so-call bolt loosening phenomena, which may possibly bring about steam turbine rotor vibrations.

Weld connection means would also be conceivable as means for connecting the steam turbine rotors made of the dissimilar metal together. In case of the weld connection means in the course of the steam turbine rotor manufacturing steps, when the rotors are extended radially and axially in the subsequent finish forging process, technical difficulties may be posed on the uniform distribution of the circumferential chemical components and compositions with a high accuracy. It may possibly cause any distortion (bend) of the steam turbine rotor in the subsequent heat treatment process or in operation. Thus, practical use thereof has not yet been achieved.

Description will then be made of weld connection means of dissimilar metal after the completion of manufacture of the steam turbine rotor. As set forth hereinabove, it has hitherto variously been put into practice to forge rotors each made of the same components and compositions such as the high pressure steam turbine rotor, intermediate pressure steam turbine rotor, high-intermediate-low steam turbine rotor and low pressure steam turbine rotor, into a disk shape and to weld them (similar material welding) to make a finished steam turbine rotor. However, practical use has not yet been made of the weld connection means for the steam turbine rotors made of dissimilar metal material of the different chemical components and compositions. Some factors therein will be conceivable.

First, it is conceived in case of the weld connection of the dissimilar metal that the welding residual stress at the weld joint tends to become larger and uneven due to the difference in values of the physical property such as the coefficient of linear expansion or thermal conductivity attributable to the difference of the chemical components and compositions of the rotor. As a result, there may occur risks of an increase in the sensitivity to SCC (stress corrosion cracking) at the weld joint and of an increase in the stress concentration at the weld Uranami (uranami) portion. A volume of pads are needed due to the increased amount of distortion of the rotor incurred by the weld, thus resulting in an increase of the rotor fabrication costs and of the number of cutting steps leading to a rise of the costs. Vibration problems may also possibly occur owing to the thermal bending in operation.

It is also envisaged due to the dissimilar metal welding that a complicated residual stress component distribution may appear at the weld joint, which may in turn incur an enhanced sensitivity to SCC.

From the common sense that the conventional high-quality steam turbine rotor should have as high a uniformity as possible at every portions irrespective of its dimensions, it would also be envisaged in case of the dissimilar metal weld connection means that the strength of the low pressure rotor at its connecting portion may lower after PWHT (postweld heat treatment) since PWHT temperature may not reach a proper value for the two steam turbine rotors to be connected together.

Assumption is such that the above-described various factors in the dissimilar metal weld connection means have impeded so far the practical use of the steam turbine rotors having the dissimilar metal weld connection structure.

Other bonding means for the dissimilar metal rotors could be a utilization of ESR (Electro Slag Refining) process. This is a process intended to axially graduate the chemical components and compositions by bonding the dissimilar metals together in the melting and solidification steep of the steam turbine rotor, which may incur a technical difficulty in imparting a circumferentially uniform distribution to the chemical components and compositions, rendering the technique impractical.

SUMMARY OF THE INVENTION

The present invention was conceived in view of the above background arts. It is therefore the object of the present invention to provide a steam turbine rotor and a method of manufacturing the same, capable of relieving the residual stress at the weld portions with appropriate components and compositions, in addition to the reduction of weight, in forming a one-piece turbine rotor for high-low pressure steam turbine, high-intermediate-low pressure steam turbine or intermediate-low pressure steam turbine through mutual connections of the dissimilar metal steam turbine rotors, the steam turbine rotor being capable of suppressing the sensitivity to stress corrosion cracking (SCC) or the bending distortion of the steam turbine, of ensuring the strength or other qualities through the sufficient postweld heat treatment (PWHT), and of sufficiently dealing with the elongated turbine blade required to meet with the demand for the increased capacity and higher efficiency of the steam turbine.

In order to attain the above object, according to a first aspect of the present invention there is provided a steam turbine rotor comprising in combination at least one of high pressure rotor and an intermediate pressure rotor and a low pressure rotor, wherein the at least one of the high pressure rotor and the intermediate pressure rotor and the low pressure rotor is formed from metal materials of different chemical compositions and being welded together by use of welding means. The high pressure rotor may be formed from 1%CrMoV steel. The low pressure rotor may be formed from 3 to 4%NiCrMoV steel. The intermediate pressure rotor may be formed from 1%CrMoV steel.

In order to achieve the above object, according to a second aspect of the present invention there is provided a steam turbine rotor comprising in combination at least one of a high pressure rotor and an intermediate pressure rotor and a low pressure rotor, wherein a high pressure turbine first stage of the high pressure rotor and an intermediate pressure turbine first stage of the intermediate pressure rotor are made of 12%Cr steel, all other high pressure turbine stages of the high pressure rotor than the high pressure turbine. first stage are made of 1%CrMoV, with all other intermediate pressure turbine stages of the intermediate pressure rotor than the intermediate pressure turbine first stage being made of 1%CrMoV, and the low pressure rotor is formed from 3–4% NiCrMoV steel, the rotors being joined together by use of welding means. The 1%CrMoV steel may contain 0.8 to 1.3 wt % of Cr, 0.8 to 1.5 wt % of Mo, 0.2 to 0.3 wt % of V and remaining parts of Fe or others. The 3–4%NiCrMoV steel may contain 2.5 to 4.5 wt % of Ni, 1.5 to 2.0 wt % of Cr, 0.3 to 0.8 wt % of Mo, 0.08 to 0.2 wt % of V and remaining parts of Fe and others. The rotor using 12%Cr steel may be shaped to have either one of a convexed end and a concaved end. The rotor using 1%CrMoV steel may be shaped to have the other of a convexed end and a concaved end, and the rotor using 12%Cr steel may be fitted to the rotor using 1%CrMoV steel and is welded thereto by use of the welding means. The convexed end and the concaved end may be inclined relative to a central axis. Preferably, a weld metal for use as the welding means contains 2.7 to 3.5 wt % of Ni, 0.2 to 0.5 wt % of Cr, 0.4 to 0.9 wt % of Mo, and remaining parts of Fe and others. After welding the high pressure rotor and/or the intermediate pressure rotor and the low pressure rotor together by use of the welding means, a turbine stage region of the high pressure rotor and/or of the intermediate pressure rotor and a turbine stage region of the low pressure rotor excepting a last turbine stage thereof may be subjected to a heat treatment by use of heat treatment means. After welding the high pressure rotor, the rotor using 12%Cr steel, the intermediate pressure rotor and the low pressure rotor together by use of the welding means, a turbine stage region excepting a last turbine stage of the high pressure rotor, the rotor using 12%Cr steel, the intermediate pressure rotor and the low pressure rotor may be subjected to a heat treatment by use of heat treatment means.

In order to attain the above object, according to a third aspect of the present invention there is provided a steam turbine rotor having in combination at least one of high pressure rotor and an intermediate pressure rotor and a low pressure rotor, the steam turbine rotor comprising a narrow gap formed at split mating surfaces extending transversely across a center bore of each of the rotors; and a laser displacement measuring sensor and a laser measuring meter which, upon welding the narrow gap, detect a displacement of each rotor arising from welding heat and a displacement of the narrow gap of the split mating surfaces, to provide a control of increase and decrease in the amount of heat input from a welding torch.

In order to attain the above object, according to a fourth aspect of the present invention there is provided a steam turbine rotor having in combination a high pressure rotor and/or an intermediate pressure rotor and a low pressure rotor, the steam turbine rotor comprising a narrow gap formed at split mating surfaces extending transversely across a center bore of each of the rotors, and submerged arc welding means arranged to weld the narrow gap. The narrow gap may have an angle of inclination of 10/100 relative to a traverse line intersecting a center axis of the rotor. The split mating surfaces may have a hollow portion formed toward the center bore.

In order to attain the above object, according to a fifth aspect of the present invention there is provided a steam turbine rotor having in combination a high pressure rotor and/or an intermediate pressure rotor and a low pressure rotor, the steam turbine rotor comprising an overlay weld joint formed toward a center bore at a weld end after welding the split mating surfaces that extend transversely across the center bore of each of the rotors.

In order to attain the above object, according to a sixth aspect of the present invention there is provided a steam turbine rotor having in combination a high pressure rotor and/or an intermediate pressure rotor and a low pressure rotor, the steam turbine rotor comprising a residual stress portion formed toward a center bore at a weld end by use of a blaster means after welding the split mating surfaces that extend transversely across the center bore of each of the rotors.

In order to attain the above object, according to a seventh aspect of the present invention there is provided a steam turbine rotor having in combination a high pressure rotor and/or an intermediate pressure rotor and a low pressure rotor, the steam turbine rotor comprising an anticorrosion coated portion formed toward the external surface of a weld end after welding the split mating surfaces that extend transversely across the center bore of each of the rotors.

In order to attain the above object, according to an eighth aspect of the present invention there is provided steam turbine rotor having in combination a high pressure rotor and/or an intermediate pressure rotor and a low pressure rotor, wherein after welding the high pressure rotor and/or the intermediate pressure rotor and the low pressure rotor together, a turbine stage region of the high pressure rotor and/or the intermediate pressure rotor and a turbine stage region of the low pressure rotor excepting a last turbine stage thereof are subjected to a heat treatment at a temperature lower than a tempering temperature of either one of the high pressure rotor and the intermediate pressure rotor, a temperature higher than a tempering temperature of the low pressure rotor and a temperature lower than an Acl transformation temperature of the low pressure rotor.

In order to attaint the above object, according to a ninth aspect of the present invention there is provided a method of manufacturing a steam turbine rotor comprising the steps of welding together a turbine first stage rotor 12%Cr steel for use as a high pressure turbine first stage and an intermediate pressure turbine first stage, a high pressure rotor 1%CrMoV steel for use as other turbine stages than the high pressure turbine first stage, an intermediate pressure rotor 1%CrMoV steel for use as other turbine stages than the intermediate pressure turbine first stage and a low pressure rotor 3–4%NiCrMoV steel; and thereafter, subjecting a turbine stage region of the turbine first stage rotor 12%Cr steel, the high pressure rotor 1%CrMoV steel and the intermediate pressure rotor 1%CrMoV steel as well as a turbine stage region excepting a final turbine stage of the low pressure rotor 3–4%NiCrMoV steel to a heat treatment at a temperature lower than a tempering temperature of eithier one of the 12%Cr steel and the 1%CrMoV steel, a temperature higher than a tempering temperature of the 3–4%NiCrMoV steel and a temperature lower than an Acl transformation temperature of the 3–4%NiCrMoV steel. The temperature of the heat treatment is preferably within a range of 600 to 650° C.

According to the steam turbine rotor and its manufacturing method of the present invention, as set forth hereinabove, appropriate metals were used under environmental conditions of high temperature/high pressure and low temperature/low pressure, and when welding rotors of dissimilar metals together, appropriate measures were taken with the reduced weight and appropriate postweld heat treatment, thereby making it possible to secure an excellent creep rupture strength under the high temperature/high pressure environment and simultaneously to secure an excellent room temperature tensile strength and toughness under the low temperature/low pressure environment, as well as making it possible to suppress the SCC sensitivity and suppress the residual stress at the weld joint as low as possible, thus ensuring a sufficient application to the turbine blade having an increased length.

Thus, the steam turbine rotor and its manufacturing method in accordance with the present invention can fully deal with an increase of steam conditions used and with an increased length of the turbine blade for use at the last turbine stage of the low pressure steam turbine, whereby it is possible to realize a large-capacity and high-efficiency steam turbine plant.

The nature and further characteristic features of the present invention will be made more clear from the following descriptions made with reference to the accompanying drawings.

DESCRIPTION OF THE PREFERRED EMBODIMENTS

A steam turbine rotor and a method of manufacturing the same in accordance with the present invention will be described hereunder with reference to the accompanying drawings which illustrate presently preferred embodiments thereof in a non-limitative manner.

Figure 1:
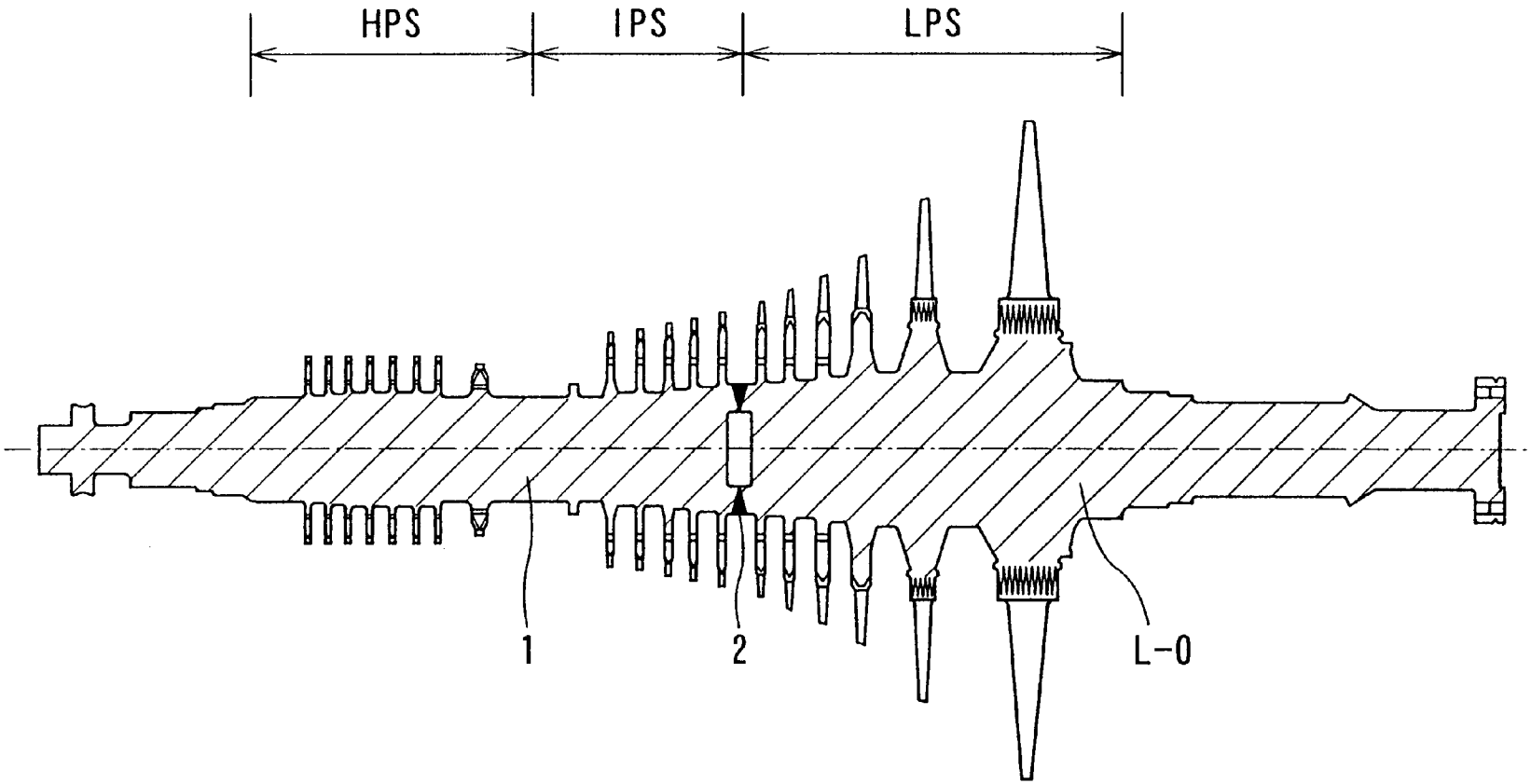
FIG. 1 is a conceptual diagram used for explaining a first embodiment of a steam turbine rotor and its manufacturing method in accordance with the present invention.

FIG. 1 is a conceptual diagram used for explaining a first embodiment of the steam turbine rotor and its manufacturing method of the present invention. For the same of ease understanding, the first embodiment employs a conventional, e.g., high-intermediate-low pressure integrated steam turbine rotor as shown in FIG. 2, the steam turbine rotor made of a single chemical component/composition metal material, unlike the, e.g., high-intermediate-low pressure steam turbine rotor of FIG. 1 made of a plurality of metals of different chemical components and compositions.

Figure 2:
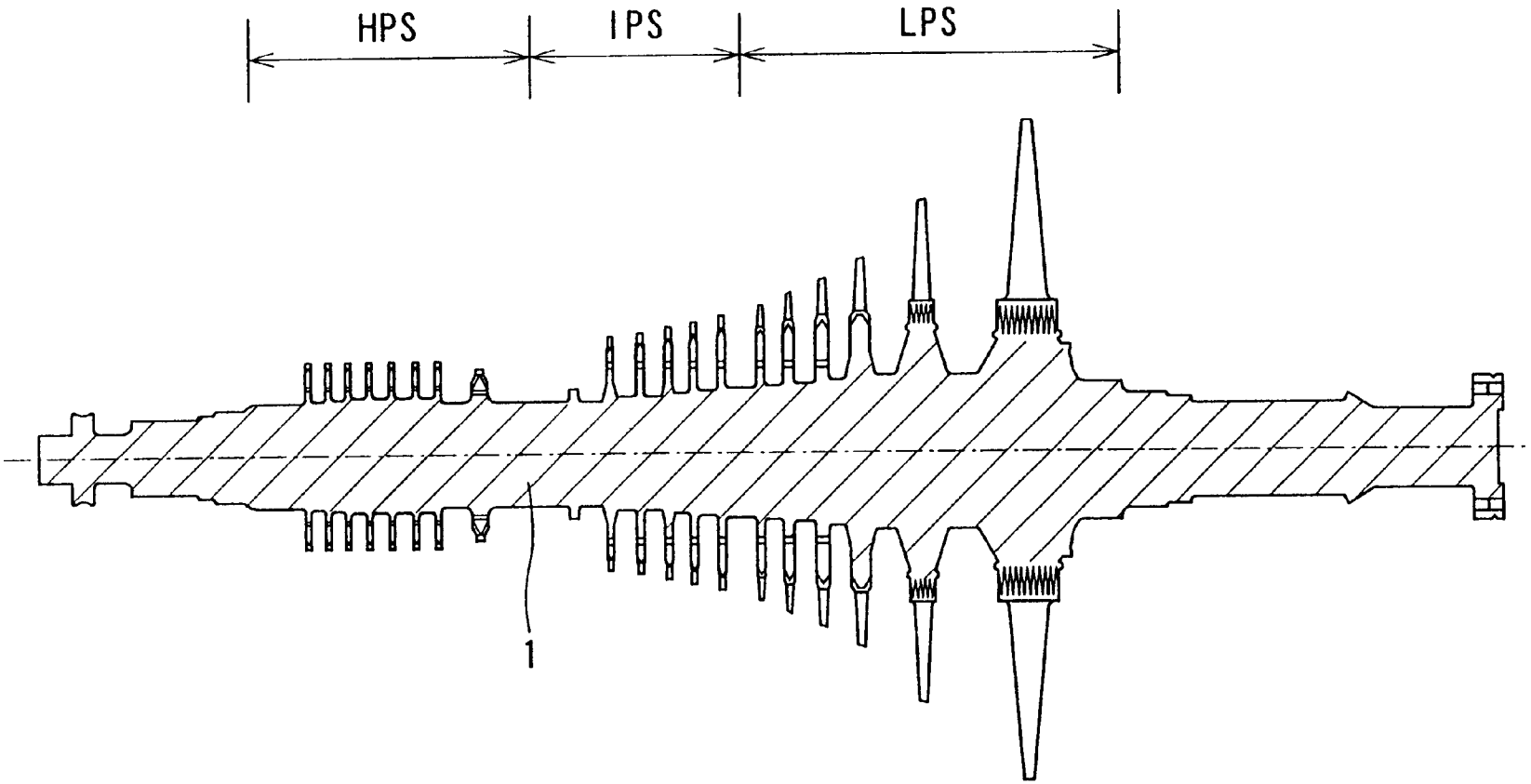
FIG. 2 is a conceptual diagram of a conventional steam turbine rotor, used for easy understanding of the steam turbine rotor shown in FIG. 1.

Excepting the materials used, the steam turbine rotors depicted in FIGS. 1 and 2 are similar to each other in that a rotor 1 is partitioned into three turbine stage segments for formation, i.e., a turbine stage high pressure segment HPS, a turbine stage intermediate pressure segment IPS and a turbine stage low pressure segment LPS.

In this embodiment, the turbine stage high pressure segment HPS and the turbine stage intermediate pressure segment IPS are initially integrally formed from the same chemical components and compositions, with the turbine stage low pressure segment LPS being separately formed from a different metal. The turbine stage intermediate pressure segment IPS and the turbine stage low pressure segment LPS are welded together at a connection point 2.

The integrally formed turbine stage high pressure segment HPS and turbine stage intermediate pressure segment IPS used 1%CrMoV steel as the rotor 1. The rotor 1 using 1%CrMoV steel had chemical components and compositions (wt %) of 0.8 to 1.3% of Cr, 0.8 to 1.5% of Mo, 0.2 to 0.3% of V with the remaining part of Fe and others. For thermal refining, it was quenched at 970° C. for 22 hours, cooled by strong wind, and then tempered at 670 ° C. for 40 hours.

On the other hand, the separately formed turbine stage low pressure segment LPS used 3.9%NiCrMoV steel for the rotor 1. The rotor 1 using 3.9%NiCrMoV steel had chemical components and compositions (wt %) of 2.4 to 4.5% of Ni, 1.5 to 2.0% of Cr, 0.3 to 0.8% of Mo, 0.08 to 0.2% of V and the remaining part of Fe and others. For thermal refining, it was quenched at 840° C. for 33 hours, cooled by water spray and then tempered at 590° C. for 50 hours.

Upon the welding at the connection point 2 of the integrally formed turbine stage high pressure segment HPS and turbine stage intermediate pressure segment IPS and the separately formed turbine stage low pressure segment LPS, the weld metal had chemical components and compositions (wt %) of 2.7 to 3.5% of Ni, 0.2 to 0.5% of Cr, 0.4 to 0.9% of Mo and the remaining part of Fe and others.

In this embodiment, for postweld heat treatment after the welding at the connection point 2 using the chemical components and compositions of the rotor 1 and the chemical components and compositions of the weld metal, with the weld portion as the border a partial heating was applied by a high-frequency coil or an electric furnace to the entire region of the turbine stage high pressure segment HPS and turbine stage intermediate pressure segment IPS and to the entire region of the turbine stage low pressure segment LPS excepting the last turbine stage L-0 The heat treatment was carried out at 610° C. for 40 hours and at 625° C. for 40 hours. For comparative consideration by comparative examples, the heat treatment was effected at 580° C. and 680° C. for 40 hours.

For comparative consideration by comparative examples, the rotor 1 for the high-intermediate/low pressure integrated steam turbine was formed from 1%CrMoV steel and 3.9%NiCrMov steel of similar components and compositions only.

Test pieces were prepared as samples from the high-intermediate-low pressure integrated steam turbine rotor for use in this embodiment and from the high-intermediate-low pressure integrated steam turbine rotor for use as the comparative examples. Various metal characteristic data are listed in the following Table 1.

TABLE 1

| | Rotor Structure | Postweld Heat Treatment | Room Temperature Tensile Strength Test Position | | | | | | | | |
|---|---|---|---|---|---|---|---|---|---|---|---|
| | Material | (× 40 h) | H1 | I4 | I5 | L-5 | L-4 | L-3 | L-2 | L-1 | L-0 |
| Comparative Example 1 | A | — | — | 822 | 820 | 815 | 825 | 822 | 820 | 820 | 822 |
| Comparative Example 2 | B | — | — | 980 | 985 | 985 | 988 | 978 | 980 | 982 | 990 |
| Comparative Example 3 | A + B | 580° C. | — | 820 | 815 | 985 | 992 | 990 | 985 | 987 | 978 |
| Comparative Example 4 | A + B | 680° C. | — | 772 | 770 | 830 | 830 | 835 | 854 | 932 | 980 |
| Example 1 | A + B | 610° C. | — | 816 | 820 | 935 | 940 | 938 | 952 | 975 | 986 |
| Example 2 | A + B | 625° C. | — | 822 | 825 | 908 | 915 | 910 | 925 | 943 | 984 |
| Example 3 | C | 625° C. | 905 | 820 | 825 | 910 | 918 | 915 | 925 | 950 | 990 |
| Example 4 | A + B | 640° C. | — | 820 | 825 | 868 | 892 | 918 | 955 | 972 | 980 |
| Example 5 | C | 640° C. | 902 | 822 | 830 | 872 | 900 | 925 | 963 | 978 | 985 |

| | FATT (%) Test Position | | | | | | | | | I Test Position | II Test Position | | III Test Position | |
|---|---|---|---|---|---|---|---|---|---|---|---|---|---|---|
| | H1 | I4 | I5 | L-5 | L-4 | L-3 | L-2 | L-1 | L-0 | L-2 | H1 | I4 | Welding Position 3a | Welding Position 3c |
| Comparative Example 1 | — | 85 | 90 | 92 | 88 | 85 | 90 | 85 | 82 | Absence | — | 90 | — | — |
| Comparative Example 2 | — | −15 | −18 | −18 | −15 | −17 | −15 | −19 | −15 | Presence | — | 35 | — | — |
| Comparative Example 3 | — | 80 | 87 | −20 | −22 | −18 | −20 | −23 | −18 | Presence | — | 88 | — | 230 |
| Comparative Example 4 | — | 50 | 55 | −48 | −45 | −50 | −33 | −25 | −17 | Absence | — | 70 | — | 45 |
| Example 1 | — | 83 | 85 | −25 | −28 | −25 | −20 | −13 | −15 | Absence | — | 92 | — | 60 |
| Example 2 | — | 85 | 88 | −38 | −34 | −30 | −26 | −22 | −16 | Absence | — | 90 | — | 52 |
| Example 3 | 35 | 85 | 90 | −40 | −40 | −32 | −25 | −20 | −13 | Absence | 130 | 92 | 60 | 55 |
| Example 4 | — | 90 | 85 | −58 | −50 | −42 | −31 | −20 | −17 | Absence | — | 90 | — | 48 |
| Example 5 | 38 | 88 | 92 | −60 | −51 | −45 | −28 | −22 | −14 | Absence | 135 | 90 | 55 | 49 |

A: 1% CrMoV Steel
B: 3.9% NiCrMoV Steel
C: 12% Cr Steel + 1% CrMoV Steel + 3.9% NiCrMoV Steel
I: SCC Cracking Sensitivity (Presence or Absence of Crack)
II: Creep Rapture Strength
III: Welded Portion Residual Stress Test items and testing conditions shown in Table 1 include room-temperature tensile strength (tensile strength at room temperature), FATT indicative toughness (ductile-brittle rupture transition temperature obtained by Charpy impact test), SCC (stress corrosion cracking) sensitivity (U(letter)-shape bending test in conformity with JIS G 0576; presence or absence of SCC is evaluated by immersion test for 1,000 hours in a 1,000 ppm sodium chloride aqueous solution), creep rupture strength (100,000 hours rupture strength at 580° C. ) and weld portion residual stress (evaluated by center drill method).

The sites to be tested were the following turbine stages. The last turbine stage of the turbine stage low pressure segment LPS was designated at L-0, and the second and third last turbine stages were designated at L-1 and L-2, respectively, with the remaining turbine stages being numbered in sequence toward the upstream of the steam. In this embodiment and the comparative examples, the turbine stage low pressure segment LPS is composed of six turbine stages L-0 to L-5.

The turbine stage intermediate pressure segment IPS was composed of five turbine stages designated at I1 to I5 in sequence from the steam inflow side. Measurement of the metal characteristics were limited to two turbine stages I4 and I5. The reason is that the metal characteristics were judged to be substantially uniform in this embodiment and comparative examples since the postweld heat treatment on the high pressure turbine stages and the intermediate pressure turbine stages were carried out at the constant temperature within the electric furnace.

In this embodiment, 1%CrMoV steel rotor 1 and 3.9%NoCrMoV steel rotor 1 were welded together and the postweld heat treatment temperature was set to 610° C. which was the intermediate temperature between the tempering temperature of 1%CrMoV steel rotor 1 and that of 3.9%NiCrMoV steel rotor 1 and which was lower than the Acl transformation temperature of 3.9%NiCrMoV steel rotor 1. By a high-frequency coil or a partial heating system within the electric furnace, the postweld heat treatment was effected, with the weld connecting portions interposed, on all the turbine stage regions of the turbine stage high and intermediate pressure segments HPS and IPS and on the turbine stage low pressure segment stage region excepting the last turbine stage L-0. As a result, a postweld heat treatment temperature gradient appearing within the range from turbine stage L-1 to the turbine stage L-3, and a gradation was recognized in the room temperature tensile strength and in the FATT characteristics. In these regions, the length of the turbine blade implanted in the rotor 1 becomes shorter than the height of the turbine stage L-0, resulting in a reduced centrifugal force upon rotations so as not to affect the strength in spite of the rotor 1 having a reduced temperature tensile strength. Rather, reduced FATT (improved toughness) and reduced SCC (stress corrosion cracking) sensitivity attendant on the lowered strength resulted and the stable operations of the rotor 1 were secured.

With no variance in the tensile strength, a high creep rupture strength of 1%CrMoV steel was kept since the postweld heat treatment temperature was lower than the 1%CrMoV steel tempering temperature. Furthermore, the residual stress at the weld portions was suppressed to as low a level as 60 MPa, and the stress relief effect by the postweld heat treatment was also obtained.

In comparison with this embodiment, the low pressure turbine stages of Comparative Example 1 presented a lower room temperature tensile strength as well as a lower toughness (higher FATT), which made it unsuitable as the high-intermediate-low pressure integrated steam turbine rotor. Comparative Example 2 had the high-intermediate pressure turbine stages presenting a lower creep rupture strength as well as the turbine stage L-2 of a higher SCC sensitivity, which again rendered it inappropriate for the high-intermediate-low pressure integrated steam turbine rotor. In Comparative Example 3, the postweld heat treatment temperature was set to be lower than the tempering temperature of 3.9%NiCrMoV steel. Its turbine stage L-2 presented a higher SCC sensitivity with the weld portions still having an extremely high residual stress, which similarly made it unsuitable as a high-intermediate-low pressure integrated steam turbine. rotor. In Comparative Example 4, the postweld heat treatment temperature was set to be higher than the tempering temperature of 1%CrMoV steel. Its high-intermediate pressure turbine stages showed a lowered creep rupture strength, which again rendered it inappropriate for the high-intermediate-low integrated steam turbine rotor.

In this manner, the first embodiment imparts excellent characteristics to the rotor 1 so as to enable the high-intermediate-low pressure integrated steam turbine to achieve stabilized operations over a longer period of time with an even higher strength.

This embodiment set the heat treatment temperature to 610° C. after the welding of 1%CrMoV steel rotor 1 and 3.9%NiCrMoV steel rotor 1. Instead, it may be set to 625° C. to obtain satisfactory results as shown in Example 2 of Table 1.

Figure 3:
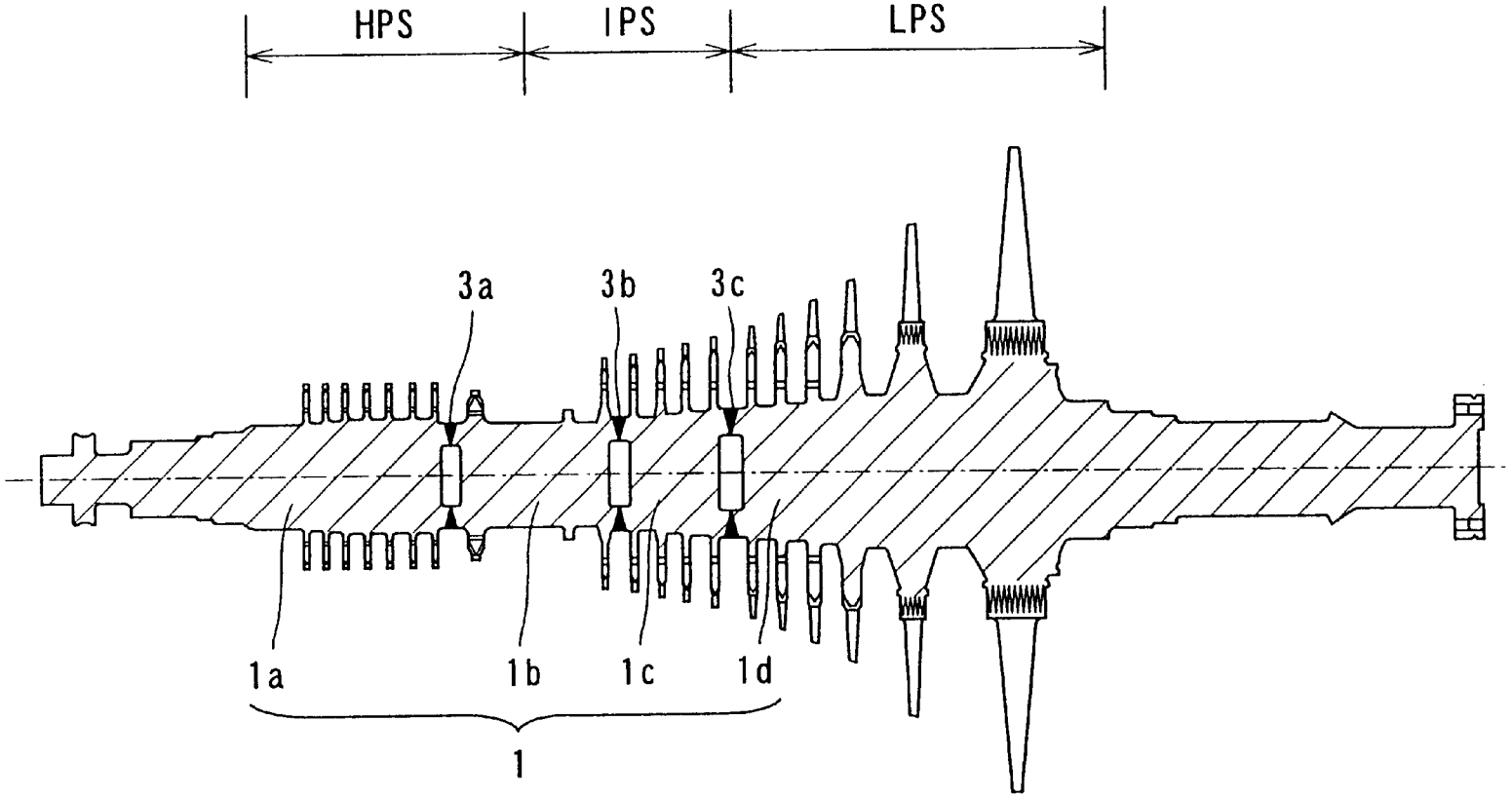
FIG. 3 is a conceptual diagram used for explaining a second embodiment of the steam turbine rotor and its manufacturing method in accordance with the present invention.

FIG. 3 is a conceptual diagram used for explaining a second embodiment of the steam turbine rotor and its manufacturing method in accordance with the present invention. The same constituent elements as those of the first embodiment are indicated by the same reference numerals.

This embodiment employed, as the material of the rotor 1, three different metals, i.e., 1%CrMoV steel, 12%Cr steel and 3.9%NiCrMov steel. 1%CrMoV steel was used for a high pressure rotor 1*a* of the turbine stage high pressure segment HPS; 12%Cr steel was used for a rotor 1*b* at a steam inlet portion between the high pressure turbine first stage of the turbine stage high pressure segment HPS and the intermediate pressure turbine first stage of the turbine stage intermediate pressure segment IPS; 1%CrMoV steel was again used for an intermediate pressure rotor 1*c*, i.e., the remaining intermediate pressure turbine stages of the turbine stage intermediate pressure segment IPS; and 3.9%NiCrMoV steel was used for a low pressure rotor 1*d* of the turbine stage low pressure segment LPS. The rotors 1*a*, 1*b*, 1*c* and 1*d* of different materials were welded together at connection points 3*a*, 3*b* and 3*c*.

The intermediate pressure rotor 1*b* made of 12%Cr steel had chemical components and compositions (wt %) of 1.05% of Cr, 1.0% of Mo, 0.25% of V, 0.07% of Nb, and Fe and others containing 0.05% of N. For thermal refining, it was quenched at 1, 050° C. for 20 hours, cooled by strong wind, and then tempered at 650° C. for 35 hours. The others were the same as the first embodiment and will not be again described.

Various characteristics of metals in the above mentioned embodiment are listed as Example 3 in Table 1 where H1 denotes data on 12%Cr steel rotor 1*b*. The SCC sensitivity test was effected on the turbine stage L-2 corresponding to the steam wetting-drying alternation site. The creep test was effected on the turbine stage I5 since the creep tends to occur at a high temperature range.

In this embodiment, a high pressure rotor 1*a* of 1%CrMoV steel, a rotor 1*b* of 12%Cr steel, an intermediate pressure rotor 1*c* of 1%CrMoV steel and a low pressure rotor 1*d* of 3.9%NiCrMoV steel were welded to each other. Herein, the rotor 1*b* was disposed at a steam inlet portion between the high pressure turbine first stage of the turbine stage high pressure segment HPS and the intermediate pressure turbine first stage of the turbine stage intermediate pressure segment IPS. The postweld heat treatment temperature was set to 625° C. which was the intermediate temperature among the tempering temperatures of 1%CrMoV steel high pressure rotor 1*a* and intermediate pressure rotor 1*c* and 3.9%NiCrMoV steel low pressure rotor 1*d* and which was lower than the Acl transformation temperature of 3.9%NiCrMoV steel low pressure rotor 1*d*. By a high-frequency coil or a partial heating system within the electric furnace, the postweld heat treatment was effected, with the weld connecting portions interposed, on all the turbine stage regions of the turbine stage high and intermediate pressure segments HPS and IPS and on the turbine stage low pressure segment stage region excepting the last turbine stage. As a result, a postweld heat treatment temperature gradient appearing within the range from turbine stage L-1 to the turbine stage L-3, and a gradation was recognized in the room temperature tensile strength and in the FATT characteristics. In these regions, the length of the turbine blade implanted in the rotor 1 becomes shorter than the height of the turbine stage L-0, resulting in a reduced centrifugal force upon rotations so that the strength is not affected in spite of the rotor 1 having a reduced temperature tensile strength. Rather, reduced FATT (improved toughness) and reduced SCC (stress corrosion cracking) sensitivity attendant on the lowered strength resulted and the stable operations of the rotor 1 were secured.

With no variance in the tensile strength, a high creep rupture strength of 1%CrMoV steel was kept since the postweld heat treatment temperature was lower than the 1%CrMoV steel tempering temperature.

On the contrary, as to the 12%Cr steel creep rupture strength, the tensile strength is substantially equal to the level of the post-refining rotor due to the postweld heat treatment temperature lower than the 12%Cr steel tempering temperature. The weld portion residual stress was as low a level as 55 MPa at the weld portion between 1%CrMoV steel rotor and 3.9%NiCrMoV steel rotor, with 60 MPa at the weld portion between 1%CrMoV steel and 12%Cr, which resulted in the acquisition of stress relief effect by the postweld heat treatment.

In this manner, the rotor 1 of this embodiment was divided for use into the four sections, i.e., the 1%CrMoV steel high pressure rotor 1, the 12%Cr steel rotor 1*b* at the steam inlet portion between the high pressure turbine first stage and the intermediate pressure turbine first stage, the 1%CrMoV steel second intermediate pressure rotor and the 3.9%NiCrMoV steel low pressure rotor 1*d*, with excellent characteristics being imparted thereto as shown in Table 1. Thus, similar to the first embodiment, the high-intermediate-low pressure integrated steam turbine rotor can achieve stable operations with a further higher strength.

Figure 4:
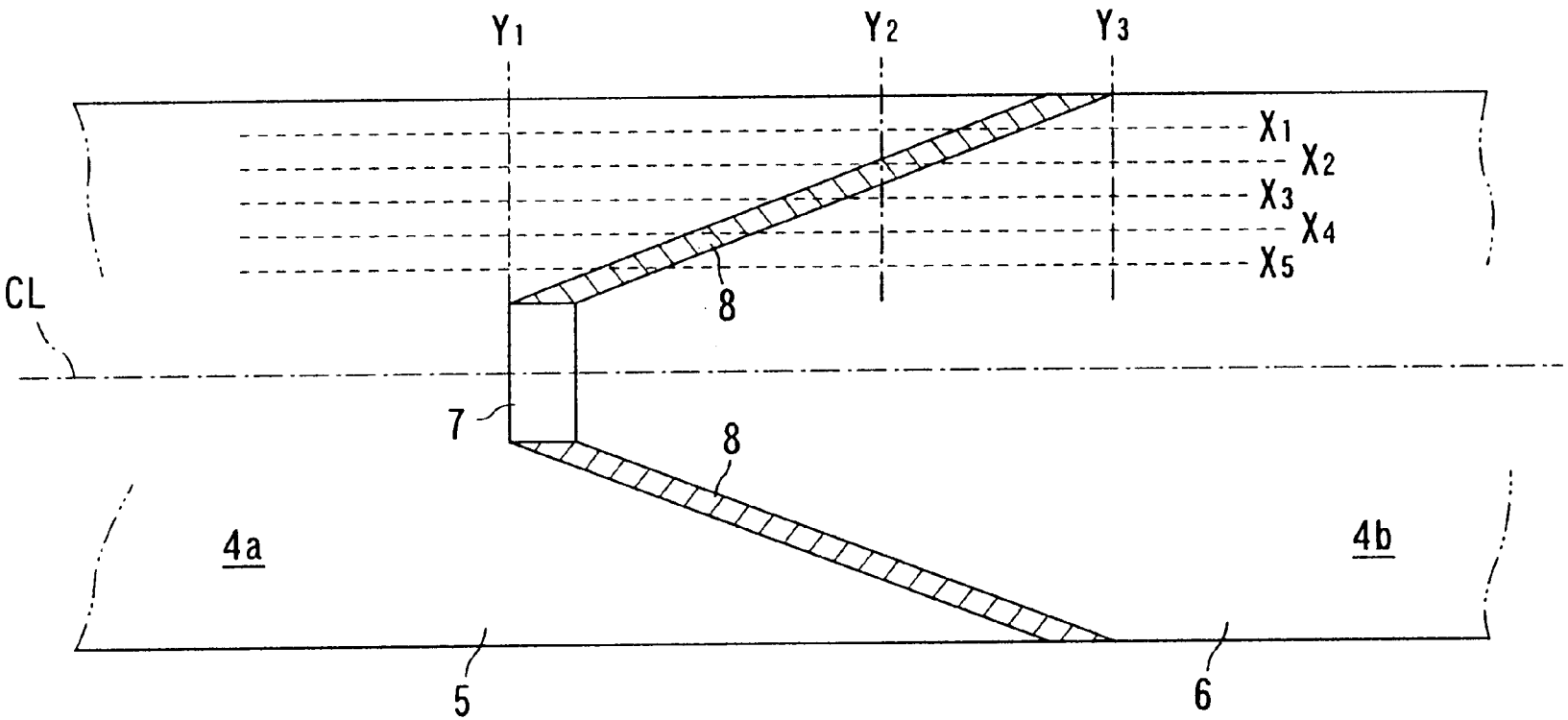
FIG. 4 is a conceptual diagram used for explaining a third embodiment of the steam turbine rotor and its manufacturing method in accordance with the present invention.

FIG. 4 is a conceptual diagram used for explaining a third embodiment of the steam turbine rotor and its manufacturing method in accordance with the present invention.

In this embodiment, when forming the high-intermediate-low pressure integrated steam turbine rotor through welding of a rotor 4*a* of 1%CrMoV steel and a rotor 4*b* of 10.5%CrMoVNbN steel (Japanese Patent Pub. No. SHO 60-054385) representative of 12%Cr steel, the 1%CrMoV steel rotor 4*a* is formed to have a concaved end portion (female portion) 5 with the 10.5%CrMoVNbN steel rotor 4*b* having a convexed end portion (male portion) 6. Specifically, the convexed end portion 6 is designed to have a flared angle within the range of θ=30° to 95° relative to a center line CL of the rotors 4*a* and 4*b*. The tip of the convexed end portion 6 is provided with a non-contact portion 7 in the form of e.g., a quadratic space that opens to the concaved end portion 5.

Extending from the 1%CrMoV steel rotor 4*a* to the 10.5%CrMoVNbN steel rotor 4*b* with the weld connecting portions 8 intervening therebetween, analytical sampling imaginary lines X1 to X5 for checking the quantity of Cr are formed in parallel with the center line CL and in sequence from radially outside to inside.

Traversing the analytic sampling imaginary lines X1 to X5, quantity-of-Cr checking positions Y1 to Y3 are formed as imaginary lines that extend from the 1%CrMoV steel rotor 4*a* to the 10.5%CrMoVNbN steel rotor 4*b* with the weld connecting portions 8 intervening therebetween.

Figure 5:
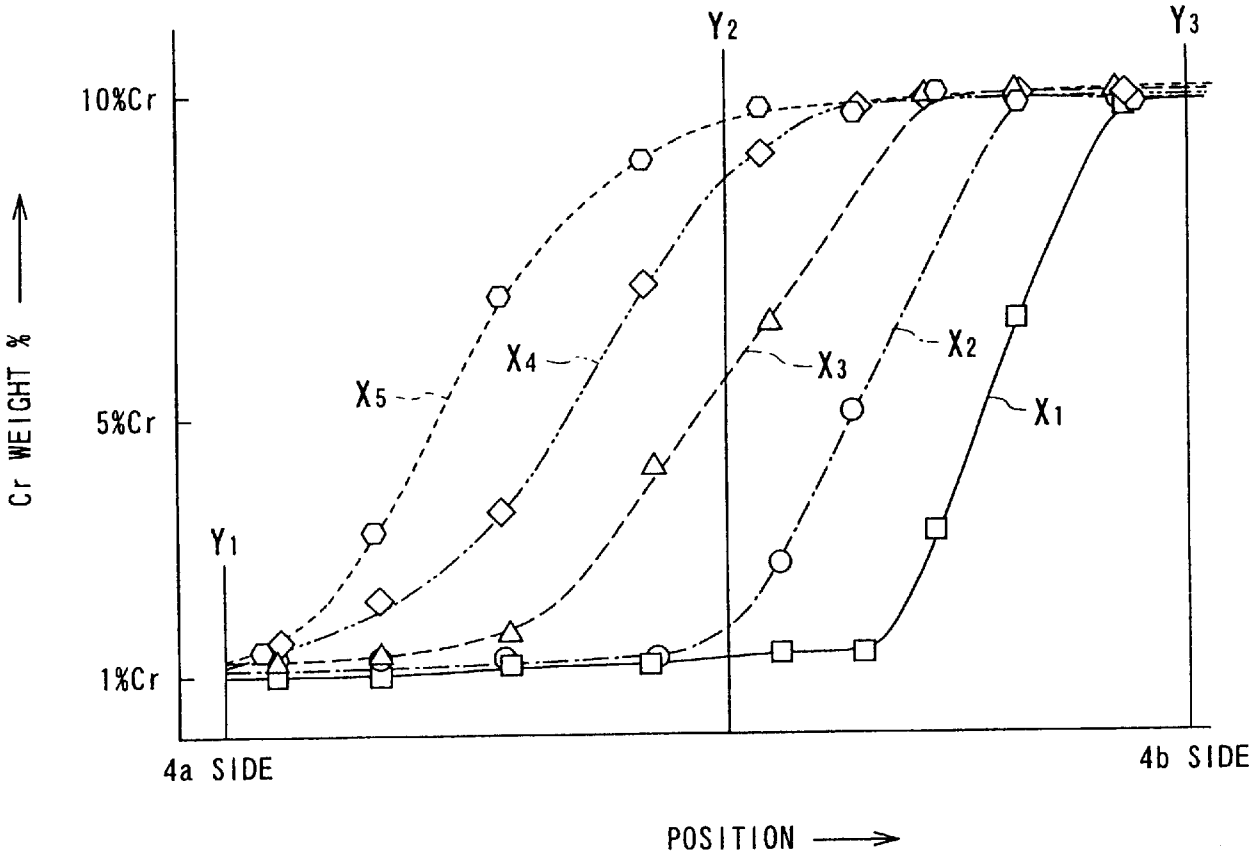
FIG. 5 is a graphical representation of the quantity of Cr contained in the steam turbine rotor shown in FIG. 4.

FIG. 5 shows the quantities of Cr obtained from the analysis by the analytic sampling lines X1 to X5.

In general, an alloy steel containing Cr of the order of 0.5 to 2.5 wt % is called a low Cr steel, and an alloy steel containing Cr of 8 to 13 wt % is called a high Cr steel (typically, 9%Cr steel, 12%Cr steel, etc.).

However, any steel for structural purposes is not common that contains the quantity of Cr (5 to 6 wt %) intermediate between the low Cr steel and the high Cr steel. This is attributable to the fact that the intermediate quantity of Cr (5 to 6 wt %) may often impair the high-temperature creep rupture strength and the room-temperature tensile strength.

Thus, the presence of an intermediate quantity of Cr (5 to 6 wt %) may be anticipated at the weld connecting portions when welding the 1%CrMoV steel rotor 4*a* and the 10.5%CrMoVNbN steel rotor 4*b* together. It is known that the weld connecting portions 8 would lower the strength along the center line CL if the weld connecting portions 8 are provided in vertical planes with respect to the center line CL between the 1%CrMoV steel rotor 4*a* and the 10.5%CrMoVNbN steel rotor 4*b* with the intermediate quantity of Cr present. In view of this respect, this embodiment allows the dissimilar metal rotors 4*a* and 4*b* when welded together to have the concaved end portion 5 and the convexed end portion 6, respectively, so that the concaved end portion 5 and the convexed end portion 6 at the weld connecting portions 8 lie within the flared angle of θ=30° to 95° relative to the center line.

From the graphical analysis of FIG. 5, the quantity of Cr on the analytic sampling line X3 is about 6 wt % at the quantity-of-Cr checking position Y2 of FIG. 4, where the strength will be lowered.

On the analytic sampling lines X1, X2 and X4, X5, however, the quantity of Cr at the position Y2 is 1 to 2 wt % and 8 to 9 wt %, respectively, where no strength lowering will occur. Thus, in the case of providing the rotors 4*a* and 4*b* with the concaved end portion 5 and the convexed end portion 6, respectively, and imparting to the weld connecting portions 8, the flared anglee lying within the range of 30° to 95° relative to the center line of the concaved 5 and convexed 6 end portions, even though an intermediate quantity of Cr appears at a certain site, the quantity of Cr will increase or decrease from the intermediate quantity of Cr at the remaining sites so that the lowered strength can sufficiently be compensated for. The same applies to the other quantity-of-Cr checking positions Y1 and Y3.

According to this manner, in the embodiment, when welding the dissimilar metal rotors 4*a* and 4*b* together, the concaved end portion 5 and the convexed end portion 6 are formed along the weld connecting portions 8 whose weld line has a flared angle θ lying within the range of 30° to 95° so that even though the quantity of Cr results in an intermediate value at a certain site, the quantity of Cr can increase or decrease at the remaining sites to ensure a departure of the quantity of Cr from the intermediate value in its entirety, whereby it is possible to compensate for the lowered strength at a certain site by the remaining sites. The rotor according to this embodiment will especially be effective for the application to the high-temperature portion such as the steam inlet portion.

Figure 6:
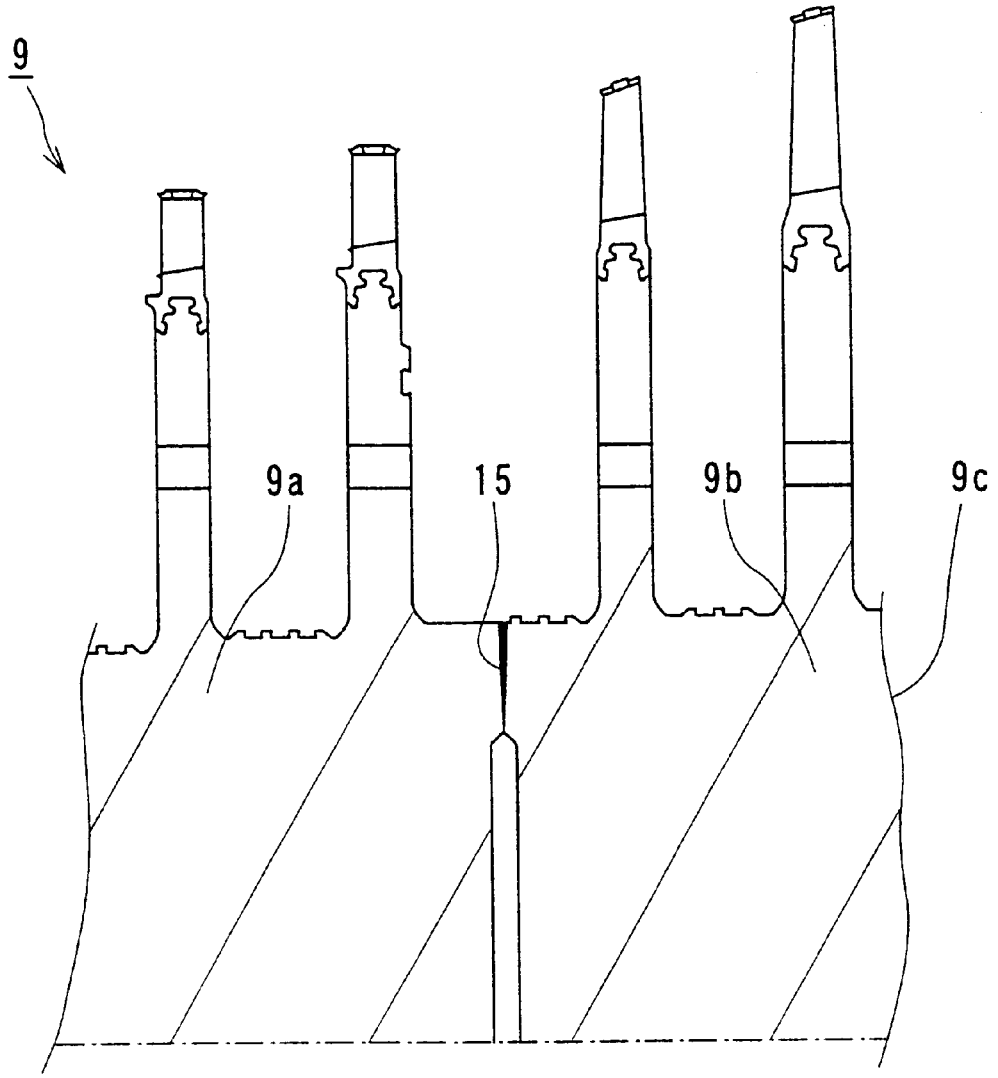
FIG. 6 is a conceptual diagram used for explaining a fourth embodiment of the steam turbine rotor and its manufacturing method in accordance with the present invention.

FIG. 6 is a schematic diagram used for explaining a fourth embodiment of the steam turbine rotor in accordance with the present invention which is formed by use of a narrow gap submerged arc welding process.

In the fourth embodiment, when welding the high pressure rotor 9*a* and the low pressure rotor 9*b* together, the rotors 9*a* and 9*b* are provided with the respective narrow gap ends on which narrow gap welded joints 15 are formed by use of a submerged arc welder.

A conventional high-low pressure integrated steam turbine rotor 9 has needed a weld deposit portion having a large volume when welding a high pressure rotor 9*a,* a low pressure rotor 9*b,* a last turbine stage rotor 9*c* and a journal bearing rotor not shown together. Such a narrow gap welding incurring a large heat input subjected the rotors 9*a,* 9*b,* 9*c,* etc., to circumferential variances in the welding conditions, which often resulted in an axial bending and thus an increase in the amount of work such as bend corrective work in the postweld process steps.

According to this embodiment, the welded joints are narrowed to a large extent by virtue of formation of the narrow gaps, whereby it is possible to prevent any axial bending of the rollers 9*a,* 9*b,* 9*c,* etc., and to reduce the amount of corrective work in the postweld process steps.

Figure 7:
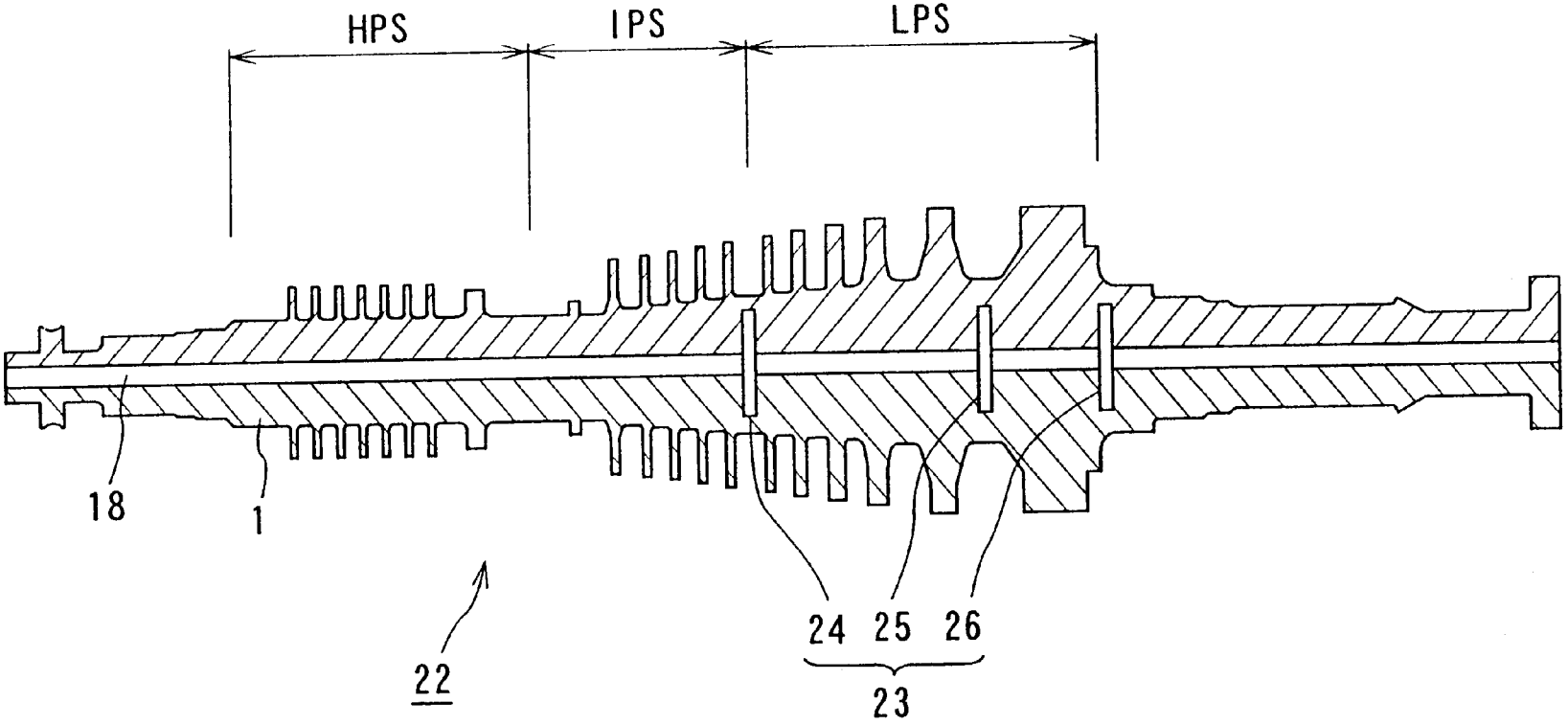
FIG. 7 is a conceptual diagram used for explaining a fifth embodiment of the steam turbine rotor and its manufacturing method in accordance with the present invention.

FIG. 7 is a conceptual diagram used for explaining a fifth embodiment of the steam turbine rotor in accordance with the present invention. The same constituent elements as those in the first embodiment are denoted by the same reference numerals.

The fifth embodiment is directed to, e.g., a high-intermediate-low pressure integrated steam turbine rotor.

In the high-intermediate-low pressure integrated steam turbine rotor 22, the rotor 1 is divided into three segments, i.e., a turbine stage high pressure segment HPS, a turbine stage intermediate pressure segment IPS and a turbine stage low pressure segment LPS. The rotor 1 is formed with an axially elongated center bore 18 for eliminating, e.g., a segregation that may appear at the central portion.

By the way, the conventional high-intermediate-low integrated steam turbine rotor 22 has imparted a sufficient high temperature creep strength to both the turbine stage high pressure segment HPS and turbine stage intermediate pressure segment IPS, but it has failed to ensure a high brittle fracture toughness of the turbine stage low pressure segment LPS. For this reason, the high-intermediate-low integrated steam turbine rotor 22 was made of metal materials of improved chemical components and compositions with the rotor 1 having two different characteristics, i.e., high-temperature creep strength and toughness/tensile strength. However, impartment of both the high-temperature strength and the toughness to a single rotor 1 could still not obviate an increase in its length. For this reason, irrespective of the more elongated rotor 1, the steam turbine will have to reduce the weight of the rotor 1 from the viewpoints of strength assurance attendant on the centrifugal force occurring in operation, suppression of vibrations, and relief of load on the bearings.

Taking those respects into consideration, the high-intermediate-low pressure integrated steam turbine rotor 22 in accordance with the present invention is formed with a hollow portion 23 that extends transversely across the center bore 18 of the rotor 1. The hollow portion 23 includes a first hollow 24 formed at the boundary between the turbine stage intermediate pressure segment IPS and the turbine stage low pressure segment LPS, and second and third hollow portions 25 and 26 formed at the inlet and output sides, respectively, of the turbine stage low pressure segment LPS.

In this manner, the fifth embodiment can reduce the weight of the rotor 1 by forming the hollow portion extending transversely across the center bore 2, thereby fully contributing to the strength assurance attendant on the centrifugal force, suppression of occurrence of vibrations, and relief of loads/burdens on the bearings.

Figure 8:
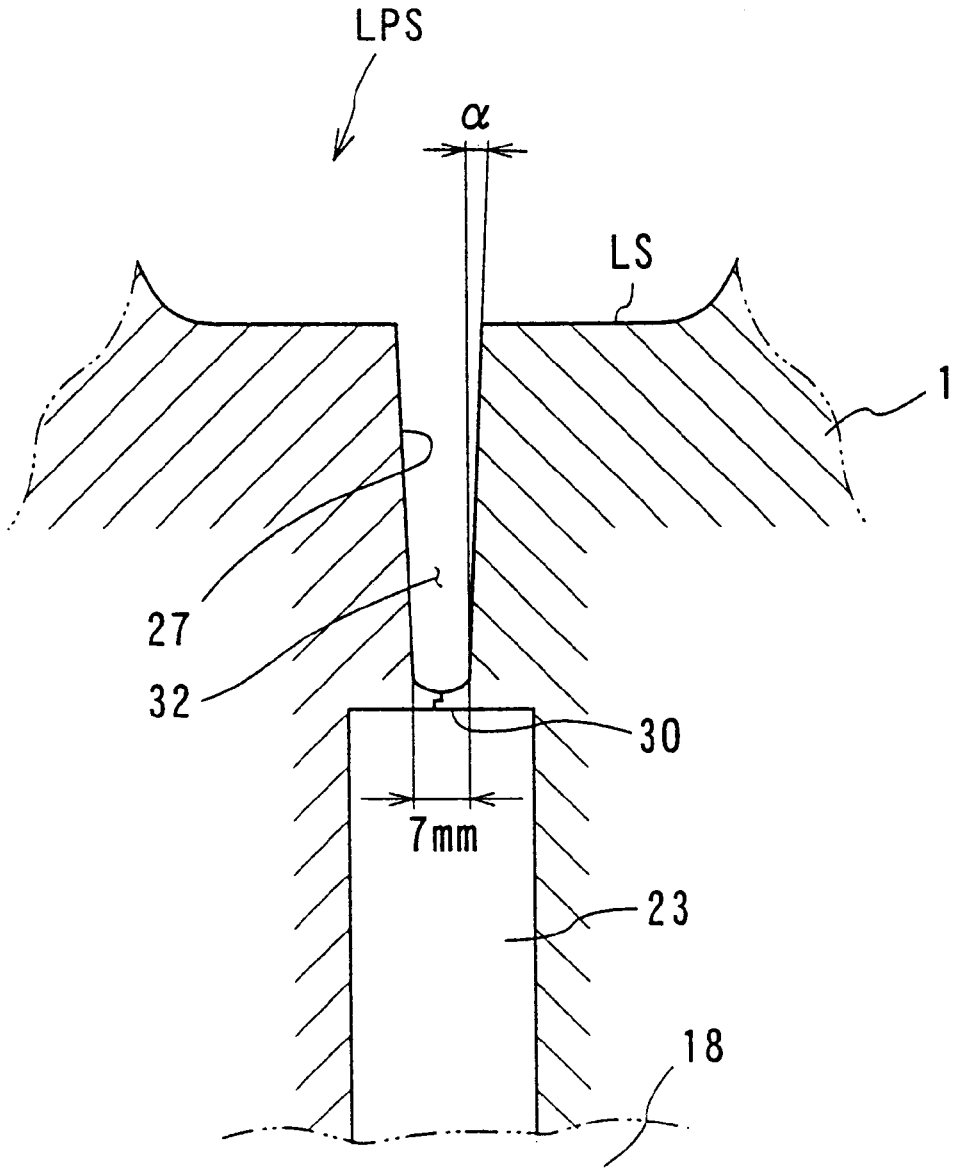
FIG. 8 is a partly cut-away fragmentary view used for explaining a sixth embodiment of the steam turbine rotor and its manufacturing method in accordance with the present invention.

FIG. 8 is a partially cut-way fragmentary sectional view used for explaining a sixth embodiment of the steam turbine rotor according to the present invention.

In the steam turbine rotor of the sixth embodiment, the last turbine stage LS of the turbine stage low pressure segment LPS for example is provided with a hollow portion 23 and split mating surfaces 27 that extend transversely across the center bore 18 of the rotor 1, the split mating surfaces 27 being formed with a narrow gap 32 whose base 30 is 7 mm in width. The angle of inclination α of the narrow gap toward the outer surface is set to 10/100.

In this manner, the sixth embodiment has the angle of inclination α set to 10/100 relative to the traverse line intersecting the center line of the rotor 1, so that upon the welding work the degree of axial shrinkage can be lessened with reduced weld bending of the rotor 1.

Figure 9:
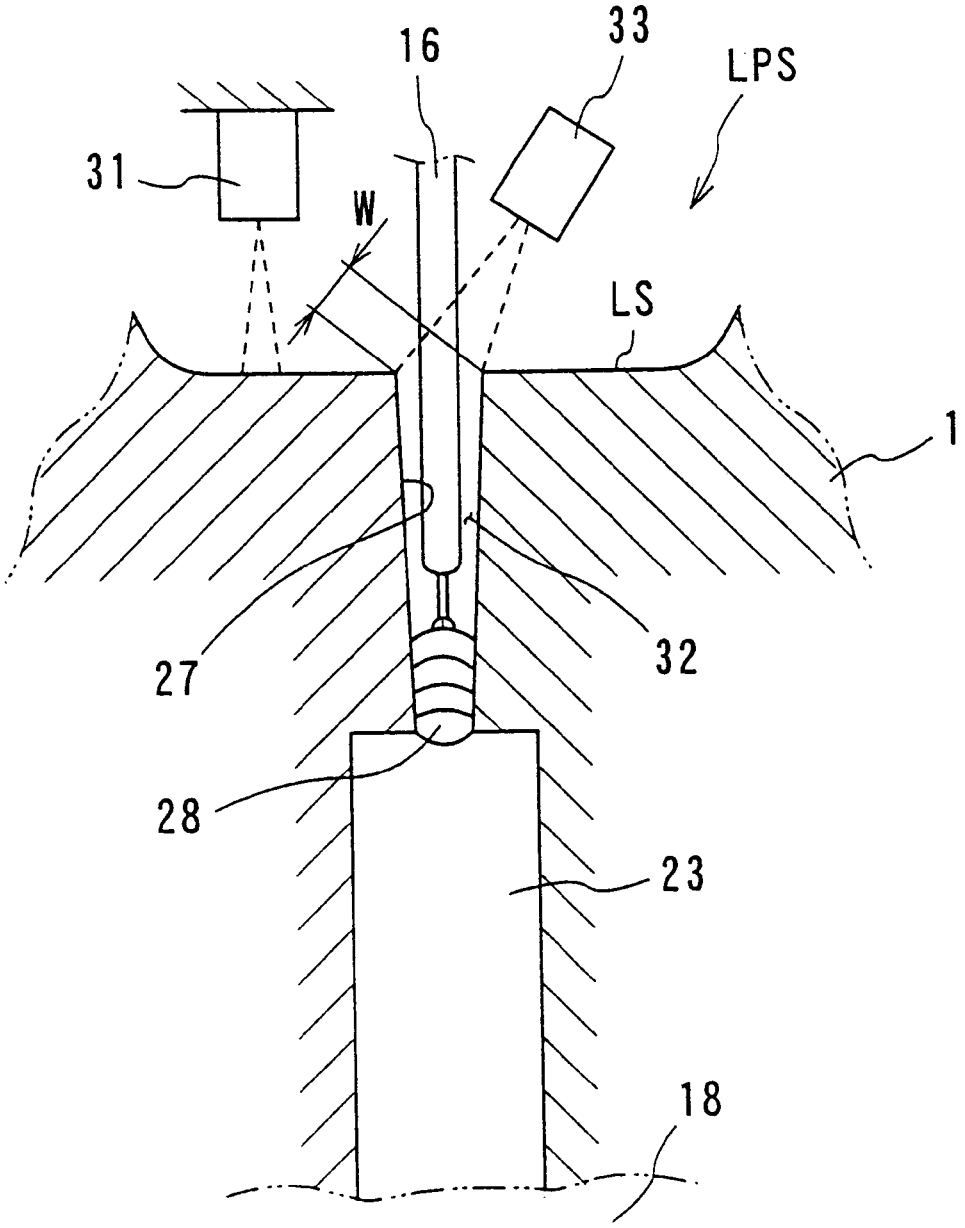
FIG. 9 is a partly cut-way fragmentary view used for explaining a seventh embodiment of the steam turbine rotor and its manufacturing method in accordance with the present invention.

FIG. 9 is a partially cut-away fragmentary sectional view used for explaining a seventh embodiment of the steam turbine rotor according to the present invention.

In the steam turbine rotor of the seventh embodiment, the last turbine stage LS of the turbine stage low pressure segment LPS is provided with a hollow portion 23 and split mating surfaces 27 that extend transversely across the center bore 18 of the rotor 1. The steam turbine rotor of this embodiment comprises a non-contact type laser displacement measuring sensor 31 for modifying the increase or decrease in the amount of heat input from a welding torch 16 when a bend occurs in the rotor 1 upon the welding of the split mating surfaces 27, and a laser measuring meter 33 for modifying the increase or decrease in the amount of heat input from the welding torch 16 when a displacement occurs in the width W of the narrow gap 32.

Conventionally, when welding the split mating surfaces of the structural member together, a high welding heat has incurred a displacement of the split mating surfaces and the groove from their respective predetermined set positions, with the result that the welded joint could not be retained in place as designed.

In view of such a deficiency, this embodiment is provided with the laser displacement measuring sensor 31 for modifying the increase or decrease in the amount of heat input from a welding torch 16 depending on the amount of displacement when the external surface of the rotor 1 is displaced under the action of the weld heat, and with the laser measuring meter 33 for modifying the increase or decrease in the amount of heat input from the welding torch 16 depending on the amount of displacement when the width W the narrow gap 32 is displaced by the action of the weld heat.

Thus, according to the present invention, it is possible to retain the welded joint in position as designed, by virtue of provision of the laser displacement measuring sensor 31 and the laser measuring meter 33 for modifying the amount of heat input from the welding torch 16 when a possible displacement occurs in the welded joint 28 and in the width W of the narrow gap 32, respectively, upon the welding of the split mating surfaces 27.

Figure 11:
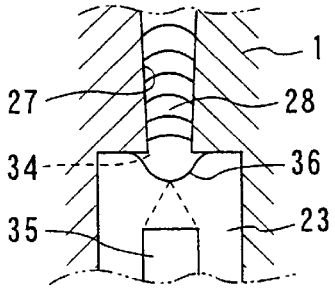
FIG. 11 is a partly cut-way fragmentary view used for explaining an eighth embodiment of the steam turbine rotor and its manufacturing method in accordance with the present invention.

FIG. 11 is a partially cut-way fragmentary sectional view used for explaining an eighth embodiment of the steam turbine rotor in accordance with the present invention.

Figure 10:
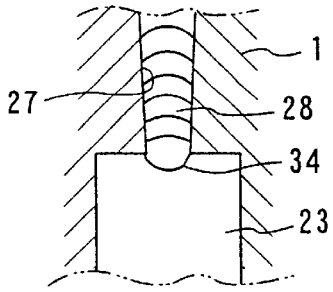
FIG. 10 is a partly cut-away fragmentary view, showing a welded portion previous to the conventional rotor mating.

In the past, when connecting the split mating surfaces 27 of the rotor 1 at the welded joint 28 as shown in FIG. 10, the steam turbine has been subjected to formation of a sharp notch 34 at the end faces of the split mating surfaces 17 associated with the hollow portion 23 due to the welding Uranami-the resultant notch 34 causing any damages arising from the stress concentration.

In view of such a deficiency, as shown in FIG. 11 the turbine rotor of this embodiment is formed with an overlay weld joint 36 smoothly finished by a laser welder 35 against the welding Uranami-induced sharp notch 34 which may appear at the end faces of the split mating surfaces 27 associated with the hollowed portion 23.

Figure 12:
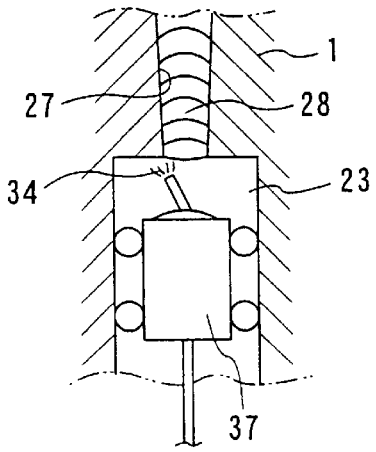
FIG. 12 is a partly cut-way fragmentary view used for explaining a ninth embodiment of the steam turbine rotor and its manufacturing method in accordance with the present invention.

Although this embodiment has formed by way of example the decorative weld joint 36 by the laser welder 35 against the welding Uranami-induced notch 34 which may appear at the end faces of the split mating surfaces 27 associated with the hollow portion 23, compressed air with alumina impalpable powder melted may be sprayed on the notch 34 by a sand-blaster 37 as shown in FIG. 12 and then removed so that a compressive stress can remain on the surface.

Figure 13:
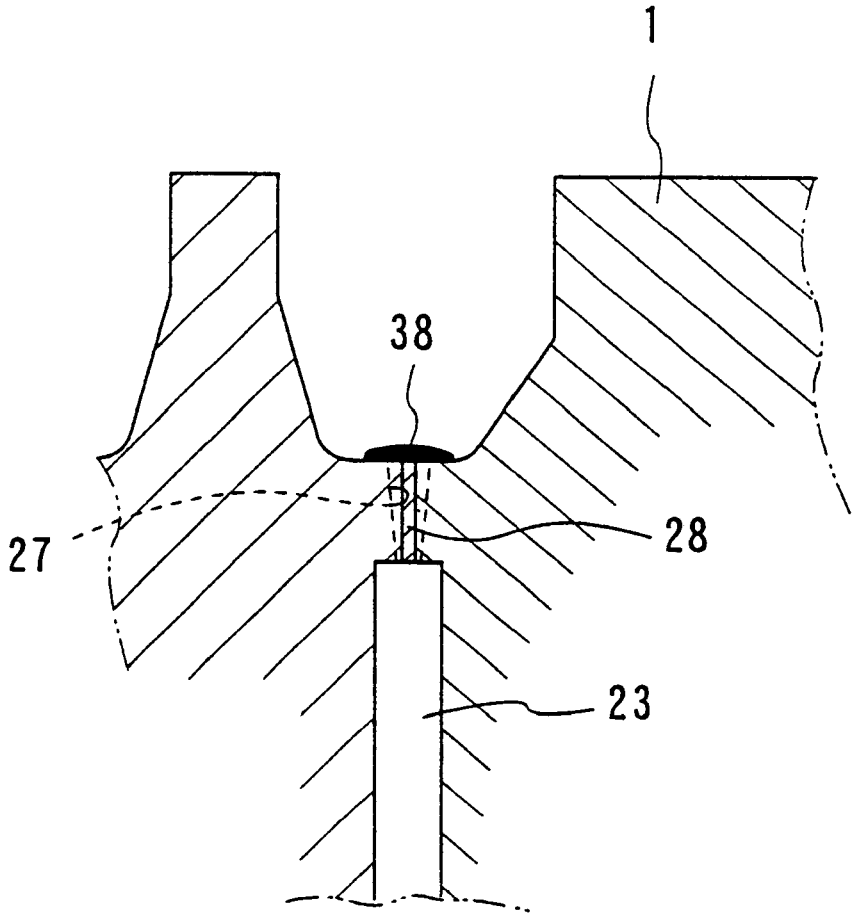
FIG. 13 is a partly cut-way fragmentary view used for explaining a tenth embodiment of the steam turbine rotor and its manufacturing method in accordance with the present invention.

FIG. 13 is a partially cut-way fragmentary view used for explaining a tenth embodiment of the steam turbine rotor in accordance with the present invention.

In the conventional steam turbine, when connecting the split mating surfaces 27 of the rotor 1 at the weld joint 28 together, the weld joint, if subjected to a high pressure and a high temperature, has often undergone corrosions as a result of use over longer period of time.

In view of such a deficiency, the steam turbine rotor of the tenth embodiment is provided with an anticorrosion coated portion 38 formed on the external surface side of the weld joint 28 of the split mating surfaces 27 continuous to the hollow portion 23 formed in the rotor 1 as shown in FIG. 13.

This embodiment can prevent the weld joint 28 from being subjected to corrosions and can ensure stable operations of the rotor 1, by the formation of the anticorrosion coated portion 38 on the weld joint 28 formed in the split mating surfaces 27 of the rotor 1.

While illustrative and presently preferred embodiments of the present invention have been described in detail herein, it is to be understood that the inventive concepts may be otherwise variously embodied and employed and that the appended claims are intended to be construed to include such variations except insofar as limited by the prior art.

What is claimed is:

1. A steam turbine rotor, comprising:

a) low pressure rotor; and b) in combination at least one of a high pressure rotor formed from 1% CrMoV steel and an intermediate pressure rotor formed from 1% CrMoV steel;

wherein each of a) said low pressure rotor and b) at least one of said high pressure rotor and said intermediate pressure rotor is formed from a metal material of a different chemical composition and welded together by means of welding.

2. A steam turbine rotor according to claim 1, wherein said low pressure rotor is formed from 3 to 4%NiCrMoV steel.

3. A steam turbine rotor according to claim 1, wherein a) said low pressure rotor and b) at least one of said high pressure rotor and said intermediate pressure rotor are welded together by said welding means, a turbine stage region of at least one of said high pressure rotor and said intermediate pressure rotor and a turbine stage region of said low pressure rotor excepting a last turbine stage thereof are thereafter subjected to a heat treatment by use of heat treatment means.

4. A combined type steam turbine rotor, comprising:

a) a low pressure rotor; and b) in combination at least one of a high pressure rotor and an intermediate pressure rotor;

wherein a high pressure turbine first stage of said high pressure rotor and an intermediate pressure turbine first stage of said intermediate pressure rotor are made of 12%Cr steel, wherein all high pressure turbine stages of said high pressure rotor other than said high pressure turbine first stage are made of 1%CrMoV, wherein all intermediate pressure turbine stages of said intermediate pressure rotor other than said intermediate pressure turbine first stage are made of 1%CrMoV, and wherein said low pressure rotor is formed from 3–4% NiCrMoV steel, said rotors being joined together using welding means.

5. A steam turbine rotor according to claim 1 or 4, wherein said 1%CrMoV steel contains 0.8 to 1.3 wt % of Cr, 0.8 to 1.5 wt % of Mo, 0.2 to 0.3 wt % of V and remaining parts of Fe or other elements.

6. A steam turbine rotor according to claim 2 or 4, wherein the 3–4%NiCrMoV steel contains 2.5 to 4.5 wt % of Ni, 1.5 to 2.0 wt % of Cr, 0.3 to 0.8 wt % of Mo, 0.08 to 0.2 wt % of V and remaining parts of Fe and other elements.

7. A steam turbine rotor according to claim 4, wherein said rotor using 12%Cr steel is shaped to have either one of a convexed end and a concaved end, said rotor using 1%CrMoV steel is shaped to have the other of a convexed end and a concaved end, and said rotor using 12%Cr steel is fitted to said rotor using 1%CrMoV steel and is welded thereto by use of said welding means.

8. A steam turbine rotor according to claim 7, wherein said convexed end and said concaved end are inclined relative to a central axis.

9. A steam turbine rotor according to claim 1, wherein said welding means is a weld material containing 2.7 to 3.5 wt % of Ni, 0.2 to 0.5 wt % of Cr, 0.4 to 0.9 wt % of Mo and a remainder of Fe and other elements.

10. A steam turbine rotor according to claim 4, wherein the said high pressure rotor, said rotor using 12%Cr steel, said intermediate pressure rotor and said low pressure rotor are welded together by use of said welding means, a turbine stage region excepting a last turbine stage of said high pressure rotor, said rotor using 12%Cr steel, said intermediate pressure rotor and said low pressure rotor is thereafter subjected to a heat treatment by use of heat treatment means.

11. A steam turbine rotor having in combination a) a low pressure rotor and b) at least one of a high pressure rotor and an intermediate pressure rotor, comprising:

a narrow gap formed at split mating surfaces extending transversely across a center bore of each of said rotors; and submerged arc welding means arranged to weld said narrow gap.

12. A steam turbine rotor according to claim 11, wherein said narrow gap has an angle of inclination of 10/100 relative to a traverse line intersecting a center axis of said rotor.

13. A steam turbine rotor according to claim 1, wherein said split mating surfaces have a hollow portion formed toward said center bore.

14. A steam turbine rotor, comprising:

a) low pressure rotor; and b) in combination at least one of a high pressure rotor and an intermediate pressure rotor;

wherein an overlay weld joint is formed toward a center bore at a weld end after welding said split mating surfaces that extend transversely across said center bore of each of said rotors.

15. A steam turbine rotor, comprising:

a) a low pressure rotor; and b) in combination at least one of a high pressure rotor and an intermediate pressure rotor;

wherein a residual stress portion is formed toward a center bore at a weld end using a blaster means after welding said split mating surfaces that extend transversely across said center bore of each of said rotors.

16. A steam turbine rotor, comprising:

a) a low pressure rotor; and b) in combination at least one of a high pressure rotor and an intermediate pressure rotor;

wherein an anticorrosion coated portion is formed toward the external surface of a weld end after welding said split mating surfaces that extend transversely across said center bore of each of said rotors.

17. A steam turbine rotor, comprising:

a) a low pressure rotor; and b) in combination at least one of a high pressure rotor and an intermediate pressure rotor, which are welded together, and a turbine stage region of at least one of said high pressure rotor and said intermediate pressure rotor and a turbine stage region of said low pressure rotor excepting a last turbine stage thereof are thereafter subjected to a heat treatment at a temperature lower than a tempering temperature of either one of said high pressure rotor and said intermediate pressure rotor, a temperature higher than a tempering temperature of said low pressure rotor and a temperature lower than an Acd transformation temperature of said low pressure rotor.

18. A method of manufacturing a steam turbine rotor comprising:

welding together e) a turbine first stage rotor 12%Cr steel for use as a high pressure turbine first stage and an intermediate pressure turbine first stage, f) a high pressure rotor 1%CrMoV steel for use as a turbine stage other than said high pressure turbine first stage, g) an intermediate pressure rotor 1%CrMoV steel for use as a turbine stage other than said intermediate pressure turbine first stage and h) a low pressure rotor 3–4%NiCrMoV steel; and thereafter subjecting a turbine stage region of said turbine first stage rotor 12%Cr steel, said high pressure rotor 1%CrMoV steel and said intermediate pressure rotor 1%CrMoV steel as well as a turbine stage region excepting a final turbine stage of said low pressure rotor 3–4%NiCrMoV steel to a heat treatment at a) a temperature lower than a tempering temperature of either one of said 12%Cr steel and said 1%CrMoV steel, b) a temperature more than a tempering temperature of said 3–4%NiCrMoV steel and c) a temperature lower than an Acl transformation temperature of said 3–4%NiCrMoV steel.

19. The method of manufacturing a steam turbine rotor according to claim 18, wherein the temperature of said heat treatment is within a range of 600 to 650° C.

20. A method of welding a rotor having in combination a) a low pressure rotor; and b) in combination at least one of a high pressure rotor and an intermediate pressure rotor, in which each of a) said low pressure rotor and b) at least one of said high pressure rotor and said intermediate pressure rotor is formed from a metal material of a different chemical composition and welded together by welding means, the method comprising:

forming a narrow gap at sprit mating surfaces extending transversely across a center bore of each of the rotors;

detecting, upon welding said narrow gap, a displacement of each rotor arising from welding heat and a displacement of said narrow gap of said split mating surfaces; and controlling increase and decrease in the amount of heat input from the welding means.

* * * * *